US005533792A

United States Patent [19]

Boucherie

[11] Patent Number: 5,533,792

[45] Date of Patent: Jul. 9, 1996

[54] METHOD AND DEVICE FOR MANUFACTURING BRUSHES

[75] Inventor: Leonel Boucherie, Izegem, Belgium

[73] Assignee: Firma G.B. Boucherie, Naamloze Vennootschap, Izegem, Belgium

[21] Appl. No.: 382,174

[22] Filed: Feb. 1, 1995

[30] Foreign Application Priority Data

Feb. 1, 1994 [BE] Belgium ..... 09400110

[51] Int. Cl.[6] ..... A46D 3/08

[52] U.S. Cl. ..... 300/11; 300/21

[58] Field of Search ..... 300/2–11, 21

[56] References Cited

U.S. PATENT DOCUMENTS

| | | | |
|---|---|---|---|
| 3,858,941 | 1/1975 | Boucherie | 300/11 X |
| 5,104,196 | 4/1992 | Boucherie | 300/11 X |

FOREIGN PATENT DOCUMENTS

| | | | |
|---|---|---|---|
| 640261 | 11/1963 | Belgium . | |
| 688533 | 10/1966 | Belgium . | |
| 697505 | 4/1967 | Belgium . | |
| 749940 | 5/1970 | Belgium . | |
| 284125 | 9/1988 | European Pat. Off. | 300/11 |
| 2006000 | 5/1979 | United Kingdom . | |

*Primary Examiner*—Mark Rosenbaum
*Attorney, Agent, or Firm*—Bacon & Thomas

[57] ABSTRACT

Method for manufacturing brushes of the type whereby use is made of a boring tool (2) and a filling tool (5), for making openings (3) in brush bodies (4) and providing brush bristles (6) in these openings respectively, characterized in that a circuit is provided to this end in which at least three brush body holders (11, 12, 13) are used, of which each time two holders present two brush bodies (4) to the boring tool (2) and the filling tool (5) respectively during a work cycle, whereas the other brush body holder carries off a filled brush body (4) and/or supplies an empty brush body (4), and in that the three brush body holders (11, 12, 13) are automatically carried to the next work station according to a closed circuit at the end of each work cycle.

17 Claims, 6 Drawing Sheets

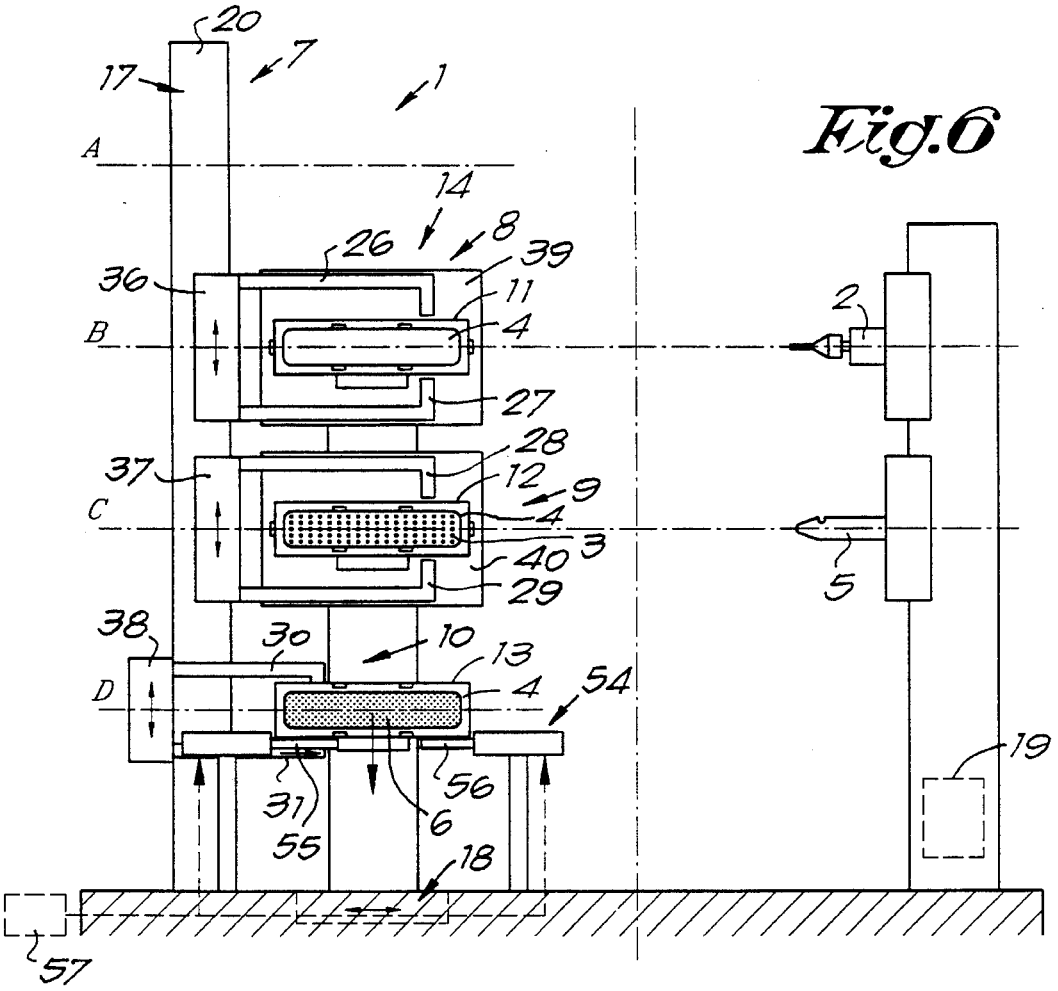
Fig.6
Fig.10
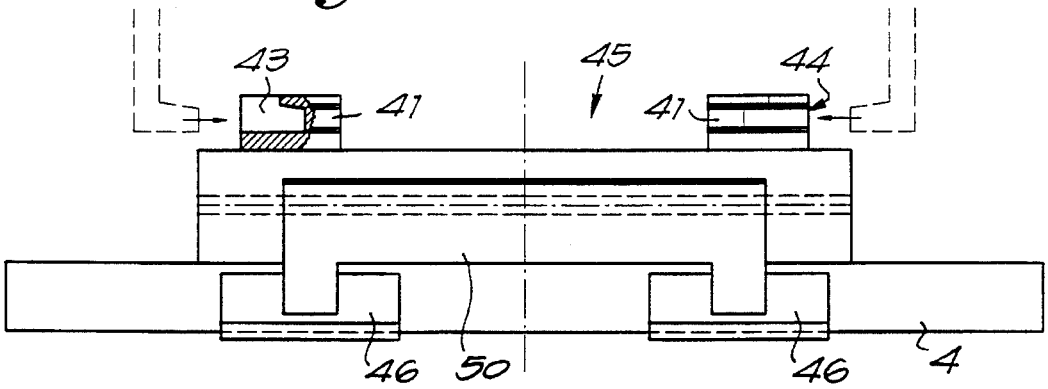

20
7
17
1
A
14

21
8
39
46
15
4
36
26
32
2
B
33
24
11
27
9
22
16
37
28
46
4
34
C
35
25
12
5
29
40
3
38
23
10
46
30
13
54
47
D
4
19
31
55
47
56
18
57

4
54
46
46
50
55
48
49
56
54

20
7
1
17
A
14
15
39
11
8
23
21
26
32
F9
30
13
2
36
B
38
27
24
10
31
22
9
12
28
C
37
40
5
25
29
16
34
D
54
19
54
55
56
18
57

4
54
46
46
50
55
48
49
56
54

METHOD AND DEVICE FOR MANUFACTURING BRUSHES

BACKGROUND OF THE INVENTION

The present invention concerns a method and device for manufacturing brushes.

In particular, the invention concerns brush manufacturing machines with at least one boring unit and at least one filling unit which have a fixed place in the machine.

The invention hereby aims to provide a method and device which offers a continuous process, which implies that the removal of a brush body filled with bristles and the positioning of a new brush body in the same brush holder takes place during the boring and filling process of the subsequent brush or brushes.

SUMMARY OF THE INVENTION

To this aim, the invention provides a method for manufacturing brushes of the type whereby use is made of a boring tool and a filling tool, for making openings in brush bodies and providing brush bristles in these openings respectively, characterized in that a circuit is provided to this end in which at least three brush body holders are used, of which each time two holders present two brush bodies to the boring tool and the filling tool respectively during a work cycle, whereas the other brush body holder carries off a filled brush body and/or supplies an empty brush body, and in that said three brush body holders are automatically carried to the next work station according to a closed circuit at the end of each work cycle.

In a preferred embodiment, the method is characterized in that it consists of at least four steps, respectively a first step, in which

- a first brush body holder with a brush body to be processed is in waiting state,
- a second brush body holder presents a brush body to a boring tool,
- a third brush body holder presents a brush body to a filling tool;

a second step, in which

- the first brush body holder with the brush body held therein is presented to the boring tool,
- the second brush body holder with the brush body held therein is presented to the filling tool,
- the third brush body holder releases the brush body held therein, which is provided with bristles, takes up a brush body to be processed and automatically goes back into the waiting state;

a third step, in which

- the third brush body holder with the brush body held therein is presented to the boring tool,
- the first brush body holder with the brush body held therein is presented to the filling tool,
- the second brush body holder releases the brush body held therein, which is provided with bristles, takes up a brush body to be processed and automatically goes back into the waiting state;

a fourth step, in which

- the second brush body holder with the brush body held therein is presented to the boring tool,
- the third brush body holder with the brush body held therein is presented to the filling tool,

- the first brush body holder releases the brush body held therein, which is provided with bristles, takes up a brush body to be processed and automatically goes back into the waiting state.

Apart from the fact that the above-mentioned aim is reached, it is clear that this method also offers the advantage that the number of brush holders can be restricted to a minimum of three.

According to the preferred embodiment, the invention is further characterized in that the boring tool and the filling tool are maintained in fixed positions in relation to the frame of the device and in relation to one another and in that only the brush body holders which present brush bodies to the tools make positioning movements without the other brush body holder carrying out these movements.

Preferably, the brush body holders are moved by means of a first holder with three moveable supports which can occupy at least three levels, and a second holder with two supports to present the brush body holders and the brush bodies held therein to the above-mentioned tools.

According to a special embodiment, the method is characterized in that the moveable supports of the first holder can take up three different positions at a first level; in that they have all three moved up one position at a second level; in that at a third level two supports situated next to one another are maintained in the same position as at the second level, whereas the third support has been moved back two positions; and in that the two supports of the second holder can work in conjunction with, on the one hand, the two above-mentioned supports of the first holder situated next to one another, and on the other hand the two above-mentioned tools.

The moveable supports of the first holder can be preferably moved mainly vertically. Consequently, the method can be realized with a device which requires very little space.

Further, the method also preferably provides in that the first holder and the second holder make a mutual lateral movement in order to pass on brush body holders to one another, and in that the second holder is turned 90° to present the brush bodies held therein to the tools.

In order to realize the above-mentioned method, the invention also provides a device, characterized in that it mainly consists of a boring tool; a filling tool; at least three brush body holders; and means to manipulate the brush body holders which, on the one hand, make sure that, during a work cycle, each time two brush body holders present two brush bodies to the boring tool and the filling tool respectively, whereas the other brush body holder of the above-mentioned three brush body holders carries off a filled brush body and/or supplies an empty brush body and, on the other hand, makes sure that each time three brush body holders are automatically taken to a following work station according to a closed circuit at the end of each work cycle.

Preferably, use is made of exactly three brush body holders.

The above-mentioned means preferably consist of a first holder with three moveable supports for brush body holders with at least three mutual levels; a second holder with two supports for brush body holders to present the brush bodies to the above-mentioned tools; drive means to move the supports; and control means which control the drive means such that, on the one hand, the moveable supports of the first holder take up three different positions at a first level, that at a second level they have all three moved one position, that at a third level two supports situated next to one another are maintained in the same position as at the second level, whereas the third support has been moved back two positions and that, on the other hand, the two supports of the second holder can cooperate with both said two supports of the first holder situated next to one another and with said two tools.

BRIEF DESCRIPTION OF THE DRAWINGS

In order to better explain the characteristics of the invention, the following preferred embodiment is given as an example only without being limitative in any way, with reference to the accompanying drawings, where:

FIGS. 5 to 8 show the device from FIG. 1 at other levels;

FIG. 10 shows a view according to arrow F10 in FIG. 9;

DETAILED DESCRIPTION OF THE PREFERRED EMBODIMENT

Figure 1:
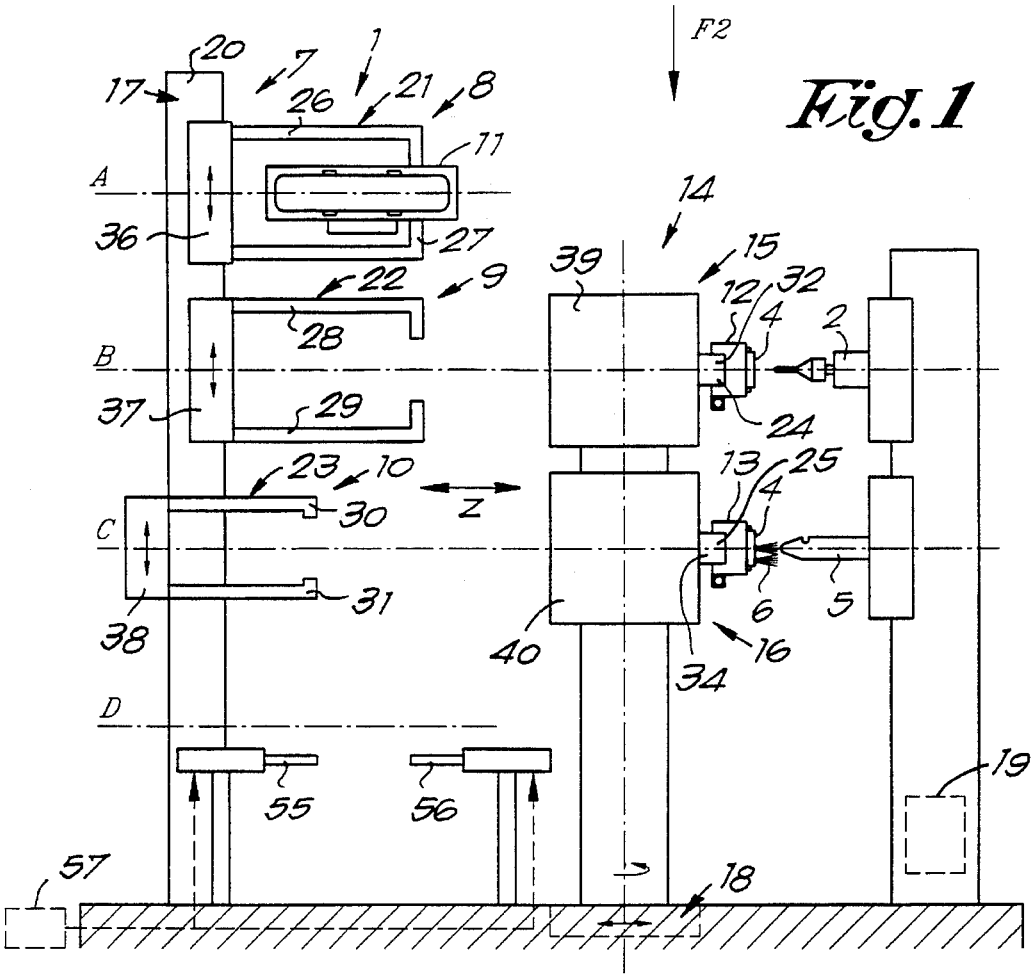
FIG. 1 is a schematic representation of a device according to the invention.

As represented in FIGS. 1 to 8, the device 1 according to the invention mainly consists of a boring tool 2 for providing openings 3 in a brush body 4; a filling tool 5 for filling the openings 3 with brush bristles 6; a first holder 7 with three moveable supports, 8, 9 and 10 respectively, which can work in conjunction with brush body holders 11, 12 and 13 and which can occupy at least three levels; a second holder 14 with two supports 15 and 16 for each time two of the brush body holders 11, 12 and 13 to present the brush bodies 4 to the above-mentioned tools 2 and 5; drive means 17 and 18 to move the supports 8, 9, 10, 15 and 16; and control means 19 which control the drive means 17 and 18 such that, on the one hand, the moveable supports 8, 9 and 10 of the first holder 7 take up three different positions at a first level, that at a second level they have all three moved one position, that at a third level two supports 8 and 9 situated next to one another, in this case on top of one another, are maintained in the same position as at the second level, whereas the third support 10 has been moved back two positions and that, on the other hand, the two supports 15 and 16 of the second holder 14 can cooperate with both said two supports 8 and 9 of the first holder 7 situated next to one another and with said two tools 2 and 5.

Figure 2:
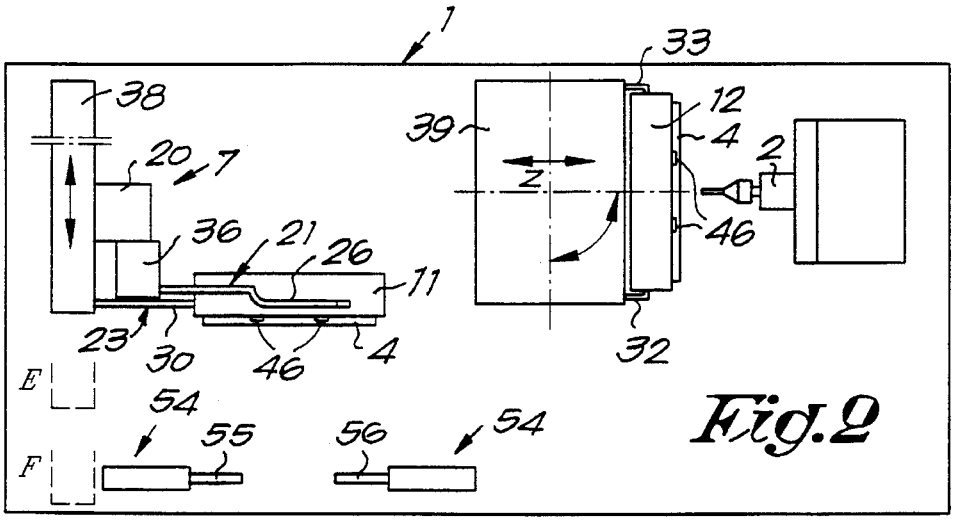
FIG. 2 shows a view according to arrow F2 in FIG. 1.
Figure 4:
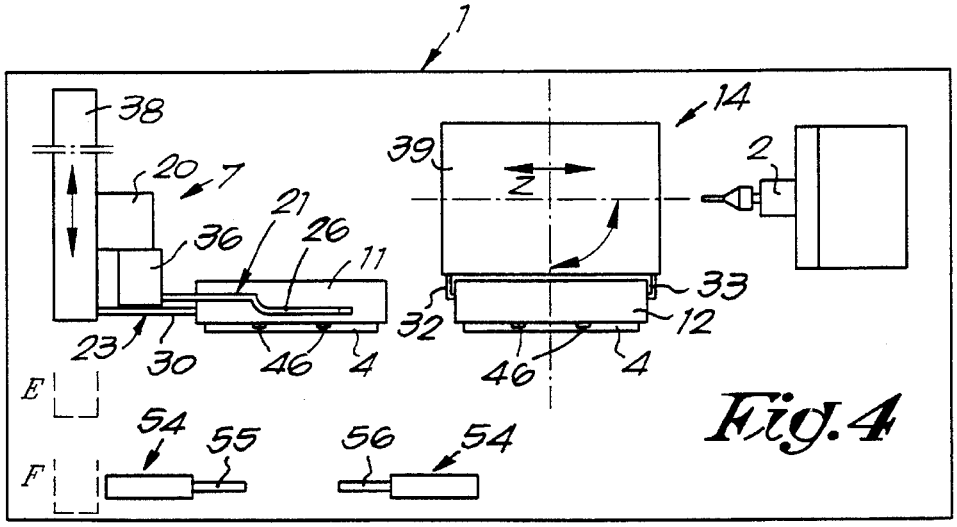
FIG. 4 shows a view according to arrow F4 in FIG. 3.

The device 1 is preferably made such that the above-mentioned different positions which can be taken up by the supports 8, 9 and 10, and which are indicated in the figures with A, B, C and D, are situated on top of one another. The movements between the different positions A, B, C and D are realized by means of the drive means 17. These drive means 17 are preferably made such that the support 8 can be moved between the positions A and B, the support 9 between the positions B and C and the support 10 between the positions C, D and B. The drive of the supports 8 and 9 can hereby be shared. Naturally, other extra movements can be provided for, for example to obtain that the different supports do not hinder each other during their movements. Thus for example, as represented in FIGS. 2 and 4, a movement towards two front positions E and F can be provided for, the aim of which will become clear from the further description.

It is clear that these drive means may be of different nature. Preferably, use is made of pressure cylinders which are built in a vertical column 20.

The above-mentioned second holder 14 can be moved laterally, as indicated with arrow Z, and can be turned 90°, such by means of the above-mentioned drive means 18.

The boring tool 2 and the filling tool 5 are situated on top of one another. In the example shown the boring tool 2 is situated above the filling tool 5. As is represented among others in FIGS. 1 and 2, the tools 2 and 5 are erected such that in the rotated position of the second holder 14, they are situated opposite the brush bodies 4 which are provided in the supports 15 and 16 of the second holder 14.

Each support 8, 9, 10, 15 and 16 is provided with a clamping mechanism, 21-25 respectively, to clench the brush body holders 11, 12 and 13 respectively. The clamping mechanisms 21 and 22 clench the brush body holders in a first place, the clamping mechanism 23 in a second place and the clamping mechanisms 24 and 25 in a third place, such that it is possible to pass on the brush body holders 11, 12 and 13 between the different supports 8, 9, 10, 15 and 16, one and other according to a method which will be described hereafter. The clamping mechanisms 21-25 preferably consist of opposite arms 26-27, 28-29, 30-31, 32-33 and 34-35, in between which the brush body holder 11, 12 or 13 can be clamped. The arms can hereby be moved towards and away from each other by means of drives, 36-40 respectively.

Figure 9:
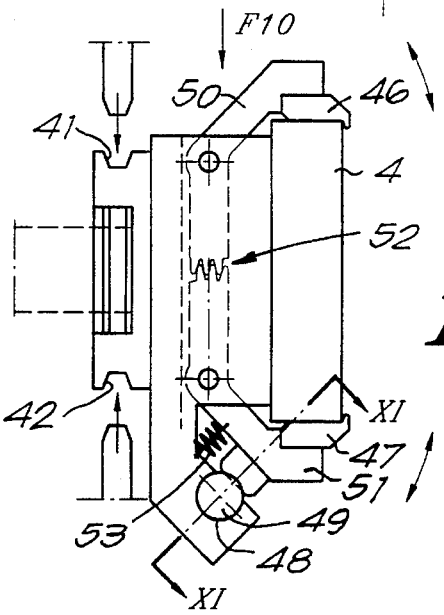
FIG. 9 shows a practical embodiment of the part which is indicated in FIG. 8 with F9.

As is represented in the practical embodiment of FIGS. 9 and 10, the arms 26-27, 28-29 and 30-31 of the supports 8, 9 and 10 can cooperate with recesses 41 and 42 provided in the brush body holders 11, 12 and 13, and the arms 32-33 and 34-35 of the supports 15 and 16 can cooperate with the recesses 43 and 44.

The brush body holders 11, 12 and 13 are preferably identical. They are all three equipped with a clamping mechanism 45 for clenching the brush bodies 4.

Figure 11:
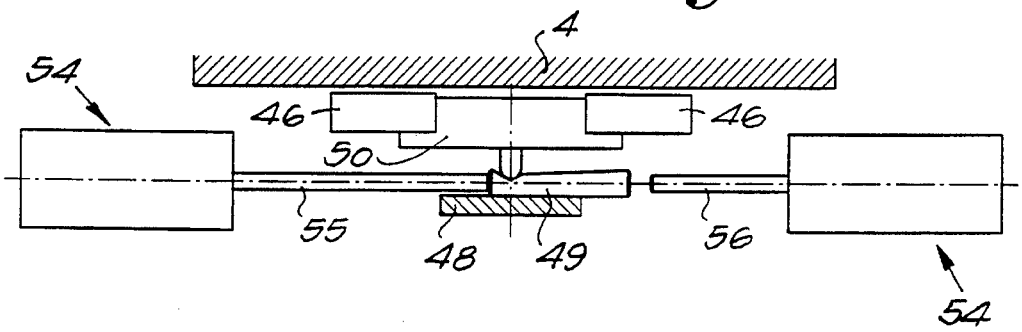
FIG. 11 is a schematic section according to line XI—XI in FIG. 9.
Figure 12:
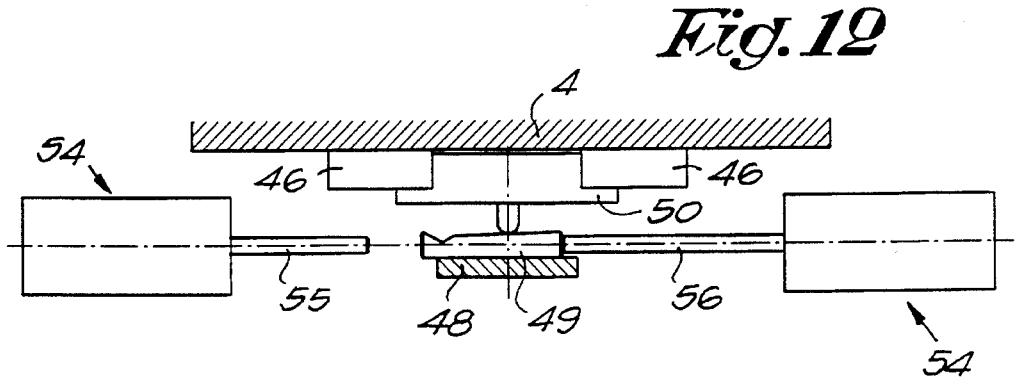
FIG. 12 shows a view analogous to that in FIG. 11, but for another level.

The clamping mechanism 45 consists of moveable clamps 46 and 47 in between which can be clamped a brush body 4, and a peg 49 which can be moved in a seating 48 which, as schematically represented in FIGS. 11 and 12, can close the clamps 46 and 47 through its shifting or allow them to open respectively. To this end, the clamps 46 and 47 can for example be provided on rotatable arms 50 and 51 which are mutually connected by means of a coupling 52, whereby the arm 51 works in conjunction with said peg 49. The opening of the clamping mechanism 45 is realized for example by means of the spring force of a spring 53. As represented in FIGS. 1 to 8 and 11 and 12, the device 1 is equipped with an operating mechanism 54 which can activate the clamping mechanism 46 in a loading and unloading position which coincides with the above-mentioned position F. This operating mechanism 54 consists for example of two pressure elements 55 and 56 which can move the peg 49 in one direction or the other. The operating mechanism 54 can hereby be controlled by means of a control element 57.

In the case of a manual supply and removal, the operating element 57 may consist of a push-button or pedal. In the case of an automatic supply and removal, it may consist of a control unit.

The working of the device 1, as well as the method of the invention will be explained step by step hereafter by means of FIGS. 1 to 8.

In a first step, as represented in FIGS. 1 and 2, the first brush body holder 11 is in waiting state with a brush body 4 to be processed in the support 8, the second brush body holder 12 is situated with a brush body 4 to be bored in the support 15 in front of the boring tool 2, and the third brush body holder 13 is situated with a brush body 4 to be filled in the support 16 in front of the filling tool 5. The brush bodies 4 in question are hereby bored and filled through mutual movements between the supports 15 and 16 and the tools 2 and 3, which is known as such and thus is not further explained.

Figure 3:
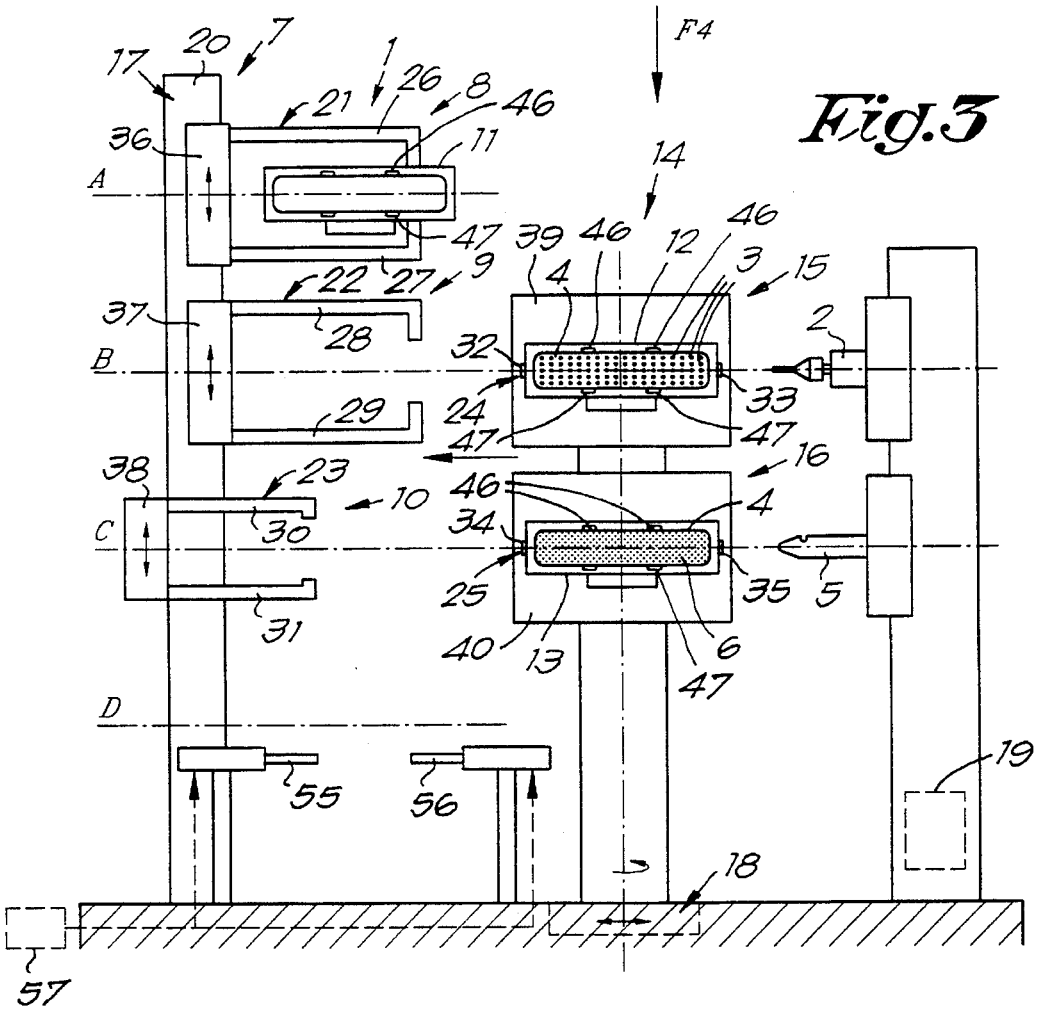
FIG. 3 shows the device from FIG. 1 at another level.

After openings 3 have been provided in the brush body 4 in the brush body holder 12, and the brush body 4 in the brush body holder 13 has been filled with brush bristles 6, the second holder 14 is turned 90° as represented in FIGS. 3 and 4.

Figure 5:
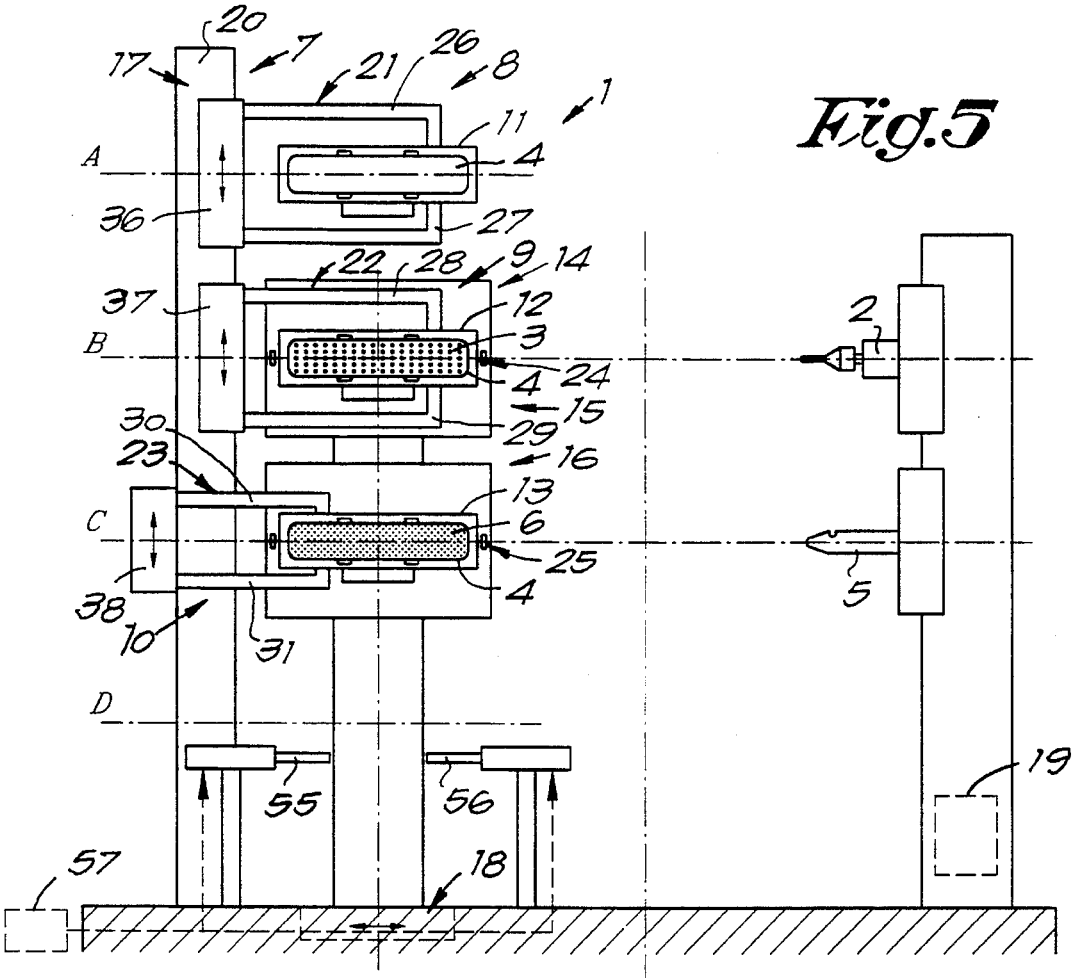

As represented in FIG. 5, the second holder 14 is then moved laterally, and the clamping mechanisms 22 and 23 are subsequently closed and the clamping mechanisms 24 and 25 are opened. Hereafter, the supports 8, 9 and 10 are moved one position, as a result of which they end up in positions B, C and D respectively as represented in FIG. 6. Subsequently, as is also represented in FIG. 6, the clamping mechanisms 21 and 22 are opened and 24 and 25 are closed. Next, the second holder 14 is moved laterally, as is represented in FIG. 7, and turned 90°, such that, as represented in FIG. 8, the following boring and filling cycle can already start, so that the continuity of the brush manufacturing is ensured.

In the meantime, the filled brush body 4 is removed and a new brush body 4 is placed in the device 1. This is possible since, as represented in FIG. 6, the clamping mechanism 45 of the brush body holder 13 is opened by means of the operating mechanism 54, as a result of which the filled brush body 4 is released from the brush body holder 13 and can be removed or carried off automatically. The brush body holder can hereby be put forward in the position F in order to make it easily accessible.

Figure 7:
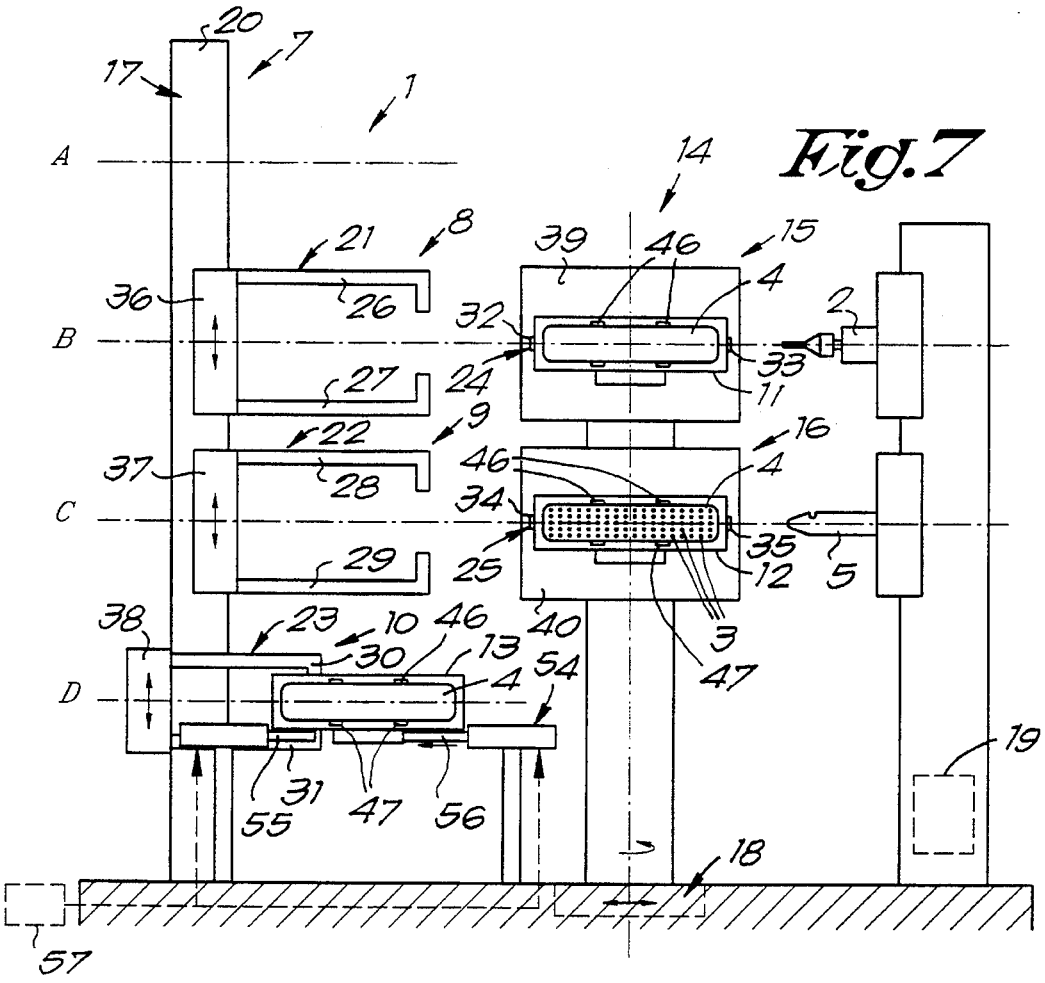

As represented in FIG. 7, a new brush body 4 can then be put in the brush body holder 13 and clamped there, the latter by closing the clamping mechanism 45 again.

Figure 8:
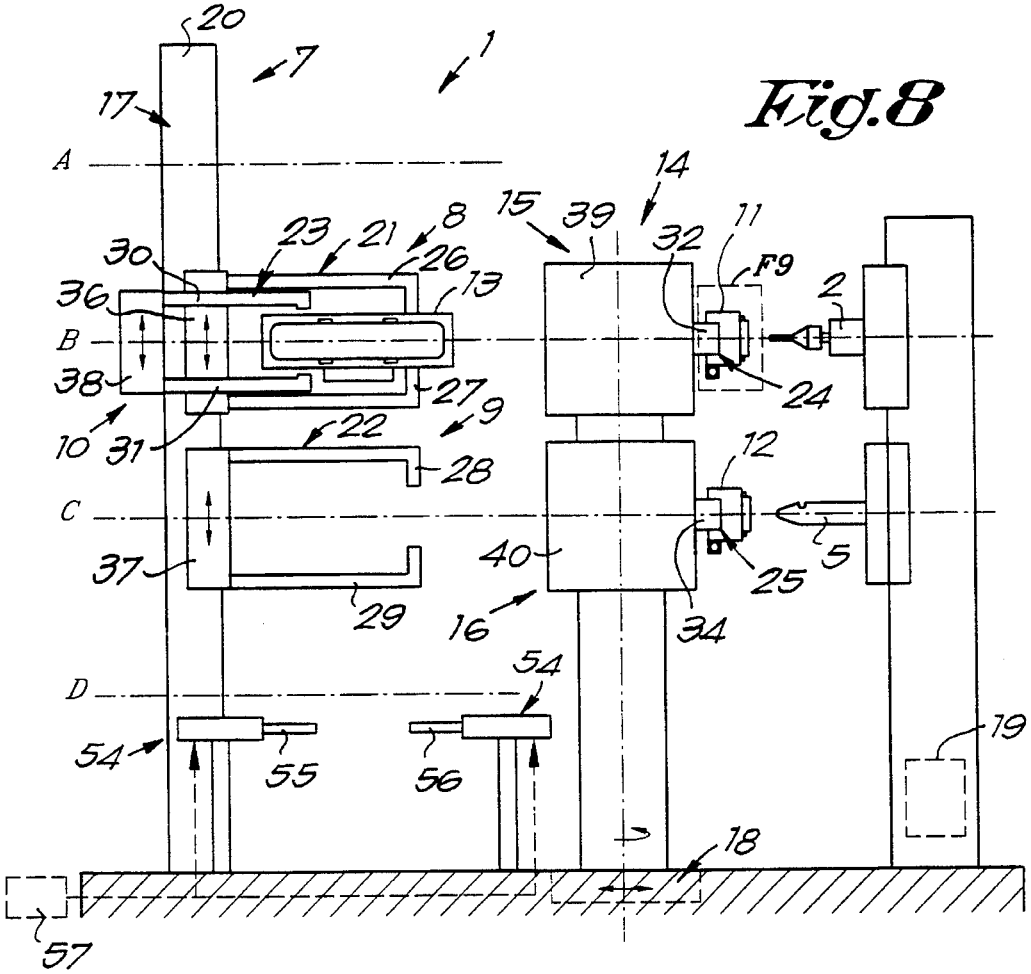

As represented in FIG. 8, the support 10 is then put in the position B with the brush body holder 13. During the upward movement, the brush body holder 13 can remain forward in position E in order to prevent it from being hindered in its upward movement. Hereafter, the clamping mechanism 23 is opened and 21 is closed. Thus, the brush body holder 13 is taken over by the support 8.

Finally, the empty support 10 is put back in position C and the supports 8 and 9 are put back in the positions A and B, which results in a situation coinciding with the initial situation of FIG. 1.

By subsequently repeating this cycle, as is described in the accompanying claim 1, whereby a finished brush is carried off each time and a new brush body 4 is supplied, a brush is made from a new brush body 4 in four steps.

The fact that the invention provides for a circuit in which only three brush body holders are active does not exclude that more than three brush body holders can be used for the manufacturing of brushes according to the invention, of which normally three are in the circuit, whereby these three holders do not necessarily have to be always the same, whereas the other brush body holders fulfil complementary functions or other functions.

Thus, for example, a buffer action can be provided for in the load position F by making use of four brush body holders. Indeed, while the circuit is closed by three brush body holders, a brush body which still needs to be bored and filled can be provided in the fourth. When the next brush body holder with a filled brush body takes up the position F, the blank brush body can then be put in the circuit in no time by automatically changing the brush body holders. The filled brush body can then stay in the brush body holder for possible extra operations, such as the shaving of the brush hair, so that reclamping is not necessary.

The present invention is by no means limited to the embodiment described as an example and represented in the accompanying drawings; on the contrary, such a method and device for manufacturing brushes can be made in all sorts of variants while still remaining within the scope of the invention.

I claim:

1. A method for manufacturing brushes comprising:

providing a boring tool and a filling tool for making openings in brush bodies and providing brush bristles in these openings at respective workstations, providing at least three brush body holders for carrying said brush bodies, presenting two of said at least three brush body holders carrying respective brush bodies to the boring tool and the filling tool respectively during a work cycle while another of said at least three brush body holders alternately carries off a filled brush body and supplies an empty brush body, and automatically carrying said three brush body holders to the next work station according to a closed circuit at the end of each work cycle.

2. The method according to claim 1, comprising at least four steps, respectively a first step, in which a first brush body holder with a brush body to be processed is placed in a waiting state, a second brush body holder presents a brush body to a boring tool, a third brush body holder presents a brush body to a filling tool;

a second step, in which the first brush body holder with the brush body held therein is presented to the boring tool, the second brush body holder with the brush body held therein is presented to the filling tool, the third brush body holder releases the brush body held therein, which is provided with bristles, takes up a brush body to be processed and automatically goes back into the waiting state;

a third step, in which the third brash body holder with the brash body held therein is presented to the boring tool, the first brash body holder with the brush body held therein is presented to the filling tool, the second brash body holder releases the brush body held therein, which is provided with bristles, takes up a brash body to be processed and automatically goes back into the waiting state;

a fourth step, in which the second brash body holder with the brash body held therein is presented to the boring tool, the third brush body holder with the brush body held therein is presented to the filling tool, the first brash body holder releases the brash body held therein, which is provided with bristles, takes up a brash body to be processed and automatically goes back into the waiting state.

3. The method according to claim 1, further comprising maintaining the boring tool and the filling tool in fixed positions in relation to a manufacturing device frame and in relation to one another and only shifting the brush body holders which present brush bodies to the boring and filling tools.

4. The method according to claim 1, further comprising moving the brush body holders by means of a first holder with three moveable supports which can assume at least three positions, and second holder with two supports in presenting the brush bodies held therein to the boring and filling tools.

5. The method according to claim 4, comprising positioning the moveable supports of the first holder in any one of three different positions a first level; shifting all three movable supports up one position at a second level; and, in a third level, maintaining two supports situated next to one another in the same position at the second level, while moving the third support back two positions; and shifting the two supports of the second holder such that the two supports can work in conjunction with, on the one hand, the two supports of the first holder situated next to one another and, on the other hand, the boring and filling tools.

6. The method according to claim 5, further comprising mutually moving the first holder and the second holder in order to pass the brush body holders to one another and to present the brush bodies held in the second holder to the boring and filling tools.

7. A device for manufacturing brushes comprising: a boring tool; a filling tool; at least three brush body holders; and means for manipulating the brush body holders such that during a work cycle, two of said at least three brush body holders present two brush bodies to the boring tool and the filling tool respectively, whereas another brush body holder of the above-mentioned three brush body holders alternately carries off a filled brush body and supplies an empty brush body and the at least three brush body holders are automatically taken to a following work station according to a closed circuit at the end of each work cycle.

8. The device according to claim 7, wherein exactly three brush body holders are provided.

9. The device according to claim 8, wherein the boring tool and the filling tool are fixed in relation to a frame of the device and in relation to one another and said manipulating means re-positions the brush body holders which present brush bodies to the tools without shifting the other brush body holder.

10. The device according to claim 7, wherein the means for manipulating the brush body holders includes a first holder with three moveable supports for the brush body holders which can occupy at least three levels; a second holder with two supports for the brush body holders to present the brush bodies to the boring and filling tools; drive means to move the supports; and control means which control the drive means such that the moveable supports of the first holder take up three different positions at a first level, at a second level all three movable supports are moved one position and at a third level two supports situated next to one another are maintained at the second level, whereas the third support has been moved back two positions and wherein the two supports of the second holder cooperate with both said two supports of the first holder situated next to one another and with said boring and filling tools.

11. The device according to claim 10, wherein said manipulating means moves the the first holder and the second holder mutually such that the first and second holders pass on brush body holders to one another, and further moves the second holder such that the brush bodies clamped therein are presented to the boring and filling tools.

12. The device according to claim 10, wherein each support is provided with a clamping mechanism for the brush body holders, whereby the clamping mechanisms of two supports of the first holder clench the brush body holders in a first place, the clamping mechanism of the third support of the first holder clench the brush body holders in a second place and the clamping mechanisms of the supports of the second holder clench the brush body holders in a third place, such that it is possible to pass on the brush body holders between the different supports.

13. The device according to claim 12, wherein the clamping mechanisms include opposite arms which mesh in recesses formed in the brush body holders.

14. The device according to claim 10, wherein the brush body holders are equipped with a clamping mechanism to clench the brush bodies; the first holder has a support which can assume a loading and unloading position and the device is equipped with an operating mechanism for activating the damping mechanism in the loading and unloading position.

15. The device according to claim 14, wherein the clamping mechanism includes moveable clamps in between which a brush body can be clamped and a peg which can be moved in a seating which can close the clamps through shifting, allow them to open respectively, and in that the operating mechanism includes two pressure elements which can move the peg in opposing directions.

16. A method of manufacturing brushes comprising:

providing a boring tool;

providing a filling tool;

providing first, second and third movable supports for supporting and shifting brush bodies between various workstations including a first workstation defined at said boring tool whereat the brush bodies are bored to produce various openings and a second workstation defined at said filling tool whereat the produced openings are filled with brush elements;

supplying a first brush body to said first movable support;

transferring said first brush body to said first workstation by shifting said first movable support;

forming various openings in said first brush body with said boring tool;

supplying a second brush body from said third movable support to said first movable support;

transferring the first brush body from said first workstation to said second movable support;

transferring the second brush body from said first movable support to said first workstation while transferring the first brush body from said second movable support to said second workstation;

forming various openings in said second brush body with said boring tool at the first workstation while inserting numerous brush elements into the first brush body with said filling tool at said second workstation;

supplying a third brush body to said first movable support by means of said third movable support;

transferring said second brush body from said first workstation to said second movable support while transferring said first brush body from said second workstation to said third movable support;

delivering said first brush body to a completed brush zone by said third movable support while transferring said second brush body from said second movable support to said second workstation and transferring the third brush body from said first movable support to said first workstation.

17. A method of manufacturing brushes according to claim 16, further comprising providing first, second and third brush body holders for carrying the brush bodies during the manufacturing of the brushes by supporting said brush body holders by said movable supports.

* * * * *